United States Patent [19]

Van Bilderbeek et al.

[11] Patent Number: 4,856,592

[45] Date of Patent: Aug. 15, 1989

[54] ANNULUS CEMENTING AND WASHOUT SYSTEMS FOR WELLS

[75] Inventors: Bernard H. Van Bilderbeek, Aberdeen; Ian F. Milne, Aberdeenshire, both of Scotland

[73] Assignee: Plexus Ocean Systems Limited, Scotland

[21] Appl. No.: 134,628

[22] Filed: Dec. 16, 1987

[30] Foreign Application Priority Data

Dec. 18, 1986 [GB] United Kingdom ..... 8630280
Jan. 16, 1987 [GB] United Kingdom ..... 8700907

[51] Int. Cl.[4] ..... E21B 33/13; E21B 21/00

[52] U.S. Cl. ..... 166/285; 166/312; 166/321; 166/382

[58] Field of Search ..... 166/285, 312, 382, 319, 166/321, 331, 240

[56] References Cited

U.S. PATENT DOCUMENTS 4,625,799 12/1986 McCormick et al. ..... 166/312 X 4,657,082 4/1987 Ringgerberg ..... 166/331 X

*Primary Examiner*—William P. Neuder

*Attorney, Agent, or Firm*—Reed Smith Shaw & McClay

[57] ABSTRACT

An annulus cementing and washout technique and equipment, particularly for use in an offshore oil or gas well. An annulus is formed between an outer casing and a second-outer casing, this annulus being filled with cement up to a predetermined level and washed free of cement above said level. The second-outer casing is fitted with a washout casing section having washports at the predetermined level. The washports are selectively opened and closed by axially moving a hollow sleeve mounted in the washout casing section, preferably by turning the sleeve on a screw thread using a remotely operated tool. Details of a suitable tool include spring-loaded radial dogs which engage axial slots within the sleeve. Use of the sleeve and the tool to move the sleeve enables the washports to be opened and closed as required without troublesome rotation or support of the casing.

9 Claims, 7 Drawing Sheets

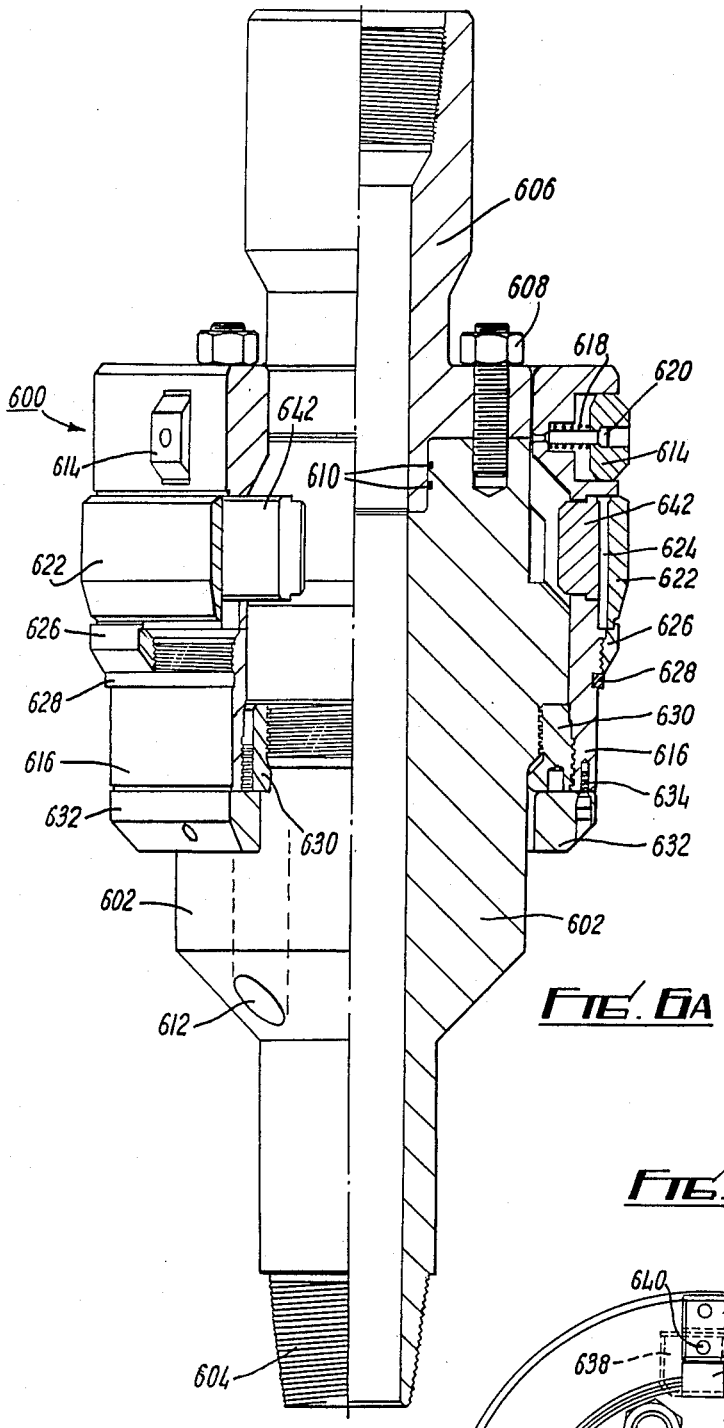
FIG. 6A
FIG. 6B
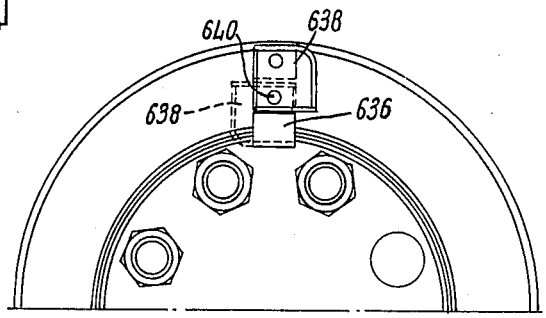

ANNULUS CEMENTING AND WASHOUT SYSTEMS FOR WELLS

This invention relates to annulus cementing and washout systems for wells.

BACKGROUND OF THE INVENTION

In the context of offshore oil and gas wells, jack-up drilling systems employ a concentric series of casings incorporating casing hangers enabling each casing to be suspended from the next outer casing such that the combined weight of the series of casings is ultimately carried by the outermost casing, and the series of casings is suspended at about the level of the mudline. This allows the drilling rig to operate in deeper water, and to disconnect from the casings after drilling, to enable the rig to move to another drilling location.

The outermost two of the series of casings generally have nominal diameters of 30 inches and 20 inches respectively. The 30 inch casing is cemented into the sea bed. The 20 inch casing is cemented into the sea where it projects downwards below the bottom end of the 30 inch, and is cemented into the 30 inch casing from the bottom end of the 30 inch casing up to a certain level below the mudline. The annulus between the 30 inch and 20 inch casings must be thoroughly washed clean of cement from the desired cement level up to the top of the casing system, both to allow disconnection of the drilling rig and to leave a clean profile onto which production equipment can be installed.

In prior art annulus washout systems, the 20 inch running tool is manipulated to open washports in the 20 inch casing. This procedure requires the 20 inch casing below the running tool to be suspended on an internal shoulder on the 30 inch casing. For structural reasons or because casings are preferably driven to refusal (limit of sea bed penetration), such an internal shoulder on the 30 inch casing cannot always be provided. The 20 inch casing is then cemented in tension, and use is made of a cumbersome and inefficient system of washpipes to clean out the annulus between the 20 inch and 30 inch casings. Even when a shoulder can be provided on the 30 inch casing, the non-rigid nature of jack-up drilling rigs results in bending loads that hamper free movement of the 20 inch running tool, hinder its manipulation to open the washports, cause damage to seals, and waste expensive rig time.

OBJECTS OF THE INVENTION

It is an object of the invention to provide an annulus cementing and washout system for wells which obviates or mitigates the abovementioned disadvantages.

SUMMARY OF THE INVENTION

According to a first aspect of the invention there is provided a washout casing section for incorporation into a casing string for use in a well, said washout casing section comprising a hollow cylindrical body adapted to form part of the length of said casing string and having at least one washport extending through said body between radially inner and outer surfaces thereof, said washout casing section further comprising a hollow cylindrical seal sleeve mounted within said body for axial movement relative thereto between a first position in which said at least one washport is closed to the passage of wash fluid therethrough, and a second position in which said at least one washport is open to the passage of wash fluid therethrough, wherein said hollow cylindrical body is connectable to the lower end of the casing string to form a hanger running tool which is preferably subsequently detachable from a lower length of casing permanently retained in position by cementation.

Said hollow cylindrical seal sleeve is preferably mounted on the interior of said hollow cylindrical body by a screw thread such that said relative axial movement of said sleeve and said body is achievable by rotating said sleeve within said body. Said sleeve preferably incorporates coupling means by which said sleeve may be rotationally coupled to a remotely operated tool by which said sleeve may be rotated to cause axial movement from one to the other of said first and second positions. Said coupling means incorporated in the sleeve preferably comprises one or more slots, grooves, keyways, or splines through which rotational torque may be applied to said sleeve by said tool, preferably by engagement with one or more radially protruding peripheral dogs, keys, or splines on said tool.

Said washout casing section preferably incorporates one or more resilient seals between said body and said sleeve to minimise undesired leakage of fluids. Said resilient seals may consist of elastomeric O-rings mounted in circumferential grooves formed on the exterior of said sleeve, and preferably disposed to lie axially on both sides of the or each washport when said sleeve is in said first position.

Said hollow cylindrical seal sleeve is preferably mounted within said hollow cylindrical body at a section of said body having an enlarged internal diameter, the body and the sleeve each having unimpeded passages axially therethrough of not less than a predetermined diameter, said predetermined diameter preferably being the internal diameter of a casing string of which the washout casing section forms part such that an object (for example a tool or a string) may be passed through the casing string of which the washout casing section forms part, without being impeded due to any part of the washout casing section having an insufficient diameter.

According to a second aspect of the invention there is provided a tool for remote operation of the washout casing section according to the first aspect of the invention, said tool comprising coupling means by which said tool may be coupled to the hollow cylindrical seal sleeve of the washout casing section such that operational movement of said tool causes axial movement of said sleeve from one to the other of said first and second positions. In the case where said hollow cylindrical seal sleeve is mounted on the interior of said hollow cylindrical body by a screw thread such that said relative axial movement of said sleeve and said body is achievable by rotating said sleeve within said body, and the sleeve incorporates rotational coupling means, said tool incorporates corresponding rotational coupling means engageable with the rotational coupling means incorporated in said sleeve such that the tool can apply torque to said sleeve to cause rotation of said sleeve within the body of the washout casing section. The rotational coupling means on said tool preferably incorporates one or more radially protruding peripheral dogs, keys, or splines, and which may be radially insertable into the tool against outward spring bias by radially inward pressure to facilitate passage of the tool through regions of restricted diameter. Said tool may incorporate one or core seals by which said tool may be coupled in a fluidtight manner to the washout casing section and/or to the casing string of which the washout casing section forms part.

According to a third aspect of the invention there is provided an annulus cementing and washout procedure for cementing an annulus between an outer casing and a secondouter casing which is the casing radially next inwards from said outer casing, at the termination of said procedure said annulus being cement-filled substantially up to a predetermined level and washed substantially free of cement above said predetermined level, said procedure comprising the steps of providing said second-outer casing with a washout casing section substantially at said predetermined level, said washout casing section comprising a hollow cylindrical body adapted to form part of the length of said casing string and having at least one washport extending through said body between radially inner and outer surfaces thereof, said washout casing section further comprising a hollow cylindrical seal sleeve mounted within said body for axial movement relative thereto between a first position in which said at least one washport is closed to the passage of wash fluid therethrough, and a second position in which said at least one washport is open to the passage of wash fluid therethrough, moving said hollow cylindrical seal sleeve to said first position if not already in said first position, pumping liquid cement into said annulus until said annulus is filled with cement at least up to said predetermined level, moving said sleeve to said second position thereby to open said at least one washport, and pressurising at least the interior of said washout casing section with wash fluid to cause said wash fluid to pass through said at least one washport into said annulus to wash cement out of said annulus above said predetermined level.

At the conclusion of annulus washout, said tool is preferably further operated to return said sleeve from said second position to said first position to re-close said at least one washport, whereafter at least the interior of said washout casing section is preferably temporarily pressurised to perform a leakage test upon the closure of said at least one washport by said sleeve.

Preferably, said second-outer casing has its lower end terminated by a float shoe, and said cement is pumped into said annulus at the lower end thereof by a stinger casing coupled into said float shoe during cementing, said stinger casing incorporating said tool as a sub at a level which is below said washout casing section during cementing. Alternatively, and particularly but not exclusively in the event of said annulus suffering a blockage or other impediment to being filled with liquid cement from the float shoe up to said predetermined level, the stinger may be lifted free of the float shoe, the second-outer casing sealed to the stinger casing at a level above the bottom end of the stinger, and liquid cement supplied through the stinger to pressurise the interior of the second-outer casing up to its seal to the stinger casing at a pressure of up to the bursting point of the second-outer casing or a pressure which causes adequate amounts of cement to pass said annulus blockage or other impediment, whichever of said pressures is the lesser, and at the conclusion of annulus cementing, commencing the washout procedure by opening the washport and washing out the interior of the second-outer casing by the application of wash fluid through the lower end of the stinger while holding said lower end of the stinger a relatively short distance above the float shoe, and continuing such application of wash fluid until the annulus is washed out as aforesaid.

BRIEF DESCRIPTION OF THE DRAWINGS

Embodiments of the invention will now be described by way of example, with reference to the accompanying drawings wherein:

FIGS. 6A and 6B show a preferred form of washsleeve operating tool, respectively in part-sectioned elevation and half plan views;

DESCRIPTION OF PREFERRED EMBODIMENTS

Figure 1:
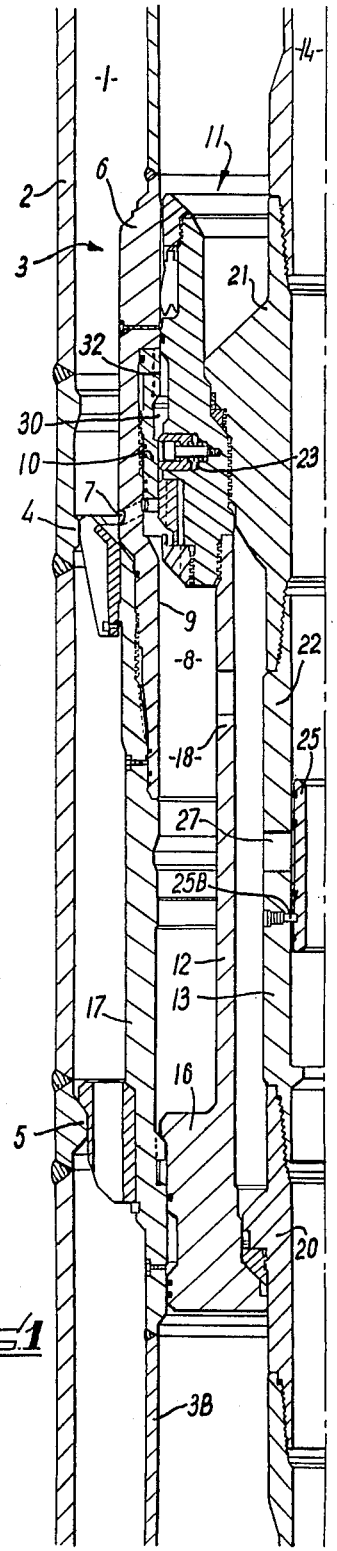
FIG. 1 is a part sectional view of a first embodiment of an annulus cementing and washout system with various components in one of two possible respective configurations.
Figure 2:
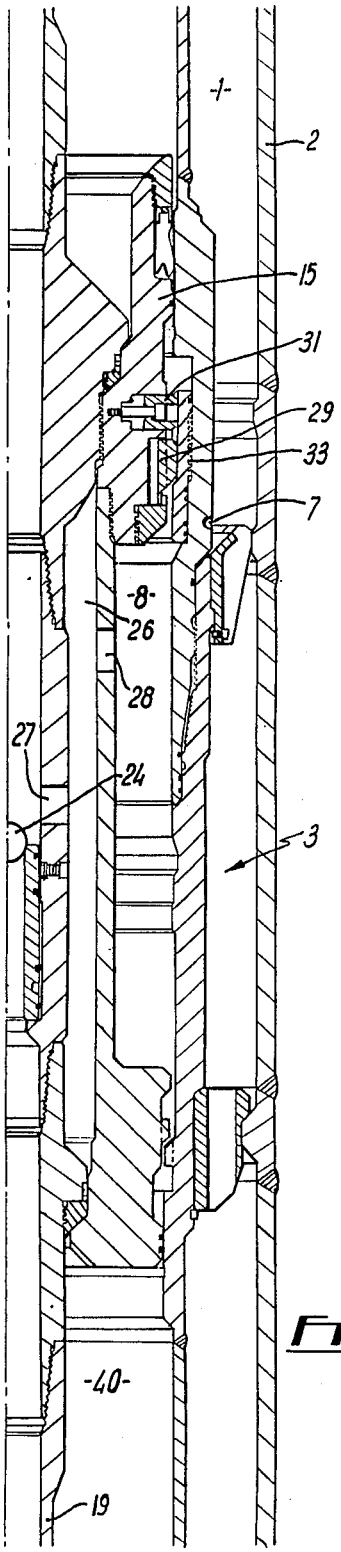
FIG. 2 corresponds to FIG. 1 but with certain components in the other of their two possible respective configurations.

Referring first to FIGS. 1 and 2, these show respectively the left half and the right half of the first embodiment, joined together at the centre line to facilitate a lateral comparison of the various components in their different configurations (corresponding to various stages of operation of the annulus cementing and washout system).

Referring now to FIGS. 1 and 2 in detail, there is shown a washout system for an annulus 1 between an outer casing in the form of a 30 inch conductor 2 and an inner casing in the form of a landed 20 inch casing hanger/running tool assembly 3. The casing hanger/running tool assembly 3 is supported on the inner face of the conductor 2, an internal shoulder 5 and centralising member 4 ensuring concentricity and parallel-position control.

The running tool 6 is provided with washports 7 which communicate between the annulus 1 and the interior space 8 of the casing hanger/running tool assembly 3. The inner face 9 of the running tool 6 is provided with a device in the form of seal sleeve 10, the axial movement of which with respect to the running tool 6 opens or closes the washports 7. The axial movement of the seal sleeve 10 is effected by manipulation of a central assembly 11 within the interior space 8 of the casing hanger/running tool assembly 3.

The central assemlby 11 is supported within and concentric with the casing hanger/running tool assembly 3 and comprises a perforated outer sleeve 12 and perforated inner sleeve 13 forming part of a drill string 14.

The outer sleeve 12 consists of a torque tool 15 to manipulate the seal sleeve 10 and a lower seal sub 16 which is engaged in the casing hanger 17 using a "J"- type or bayonet profile and seals within the casing hanger 17. Provision is made to test the seals of the seal sub 16 and the upper seals of the torque tool 15 prior to running the assembly to the mudline. These two subs 15, 16 are connected and attached to one another by a screw fitting at the top of a perforated extension 18 to the seal sub 16 and a corresponding screw thread at the lower part of the torque tool 15.

The inner sleeve 13 is hydraulically continuous with a cement string 19 consisting of three subs 20, 21, 22 which are installed on the drill string 14 such that, when the inner sleeve 13 is engaged with the outer sleeve 12, the end of the cement string 19 is two to three feet above the cement shoe (not shown) which is installed at the lower end of the 20 inch casing string 3B.

The lower sub 20 of the inner sleeve 13 provides a means of attaching the cement string 19 while providing a seal with the seal sub 16 of the outer sleeve 12.

The upper sub 21 of the inner sleeve 13 provides screw thread engaging means 23 for the inner and outer sleeves 12, 13 whilst also sealing with the torque mechanism 15 of the outer sleeve 12. The upper profile of the sub 21 can be prepared to suit the particular method of cementing; for example, if the inner and outer sleeves 12, 13 are stabbed and mutually connected either in the drilling rig or else remotely at the mudline.

Figure 3:
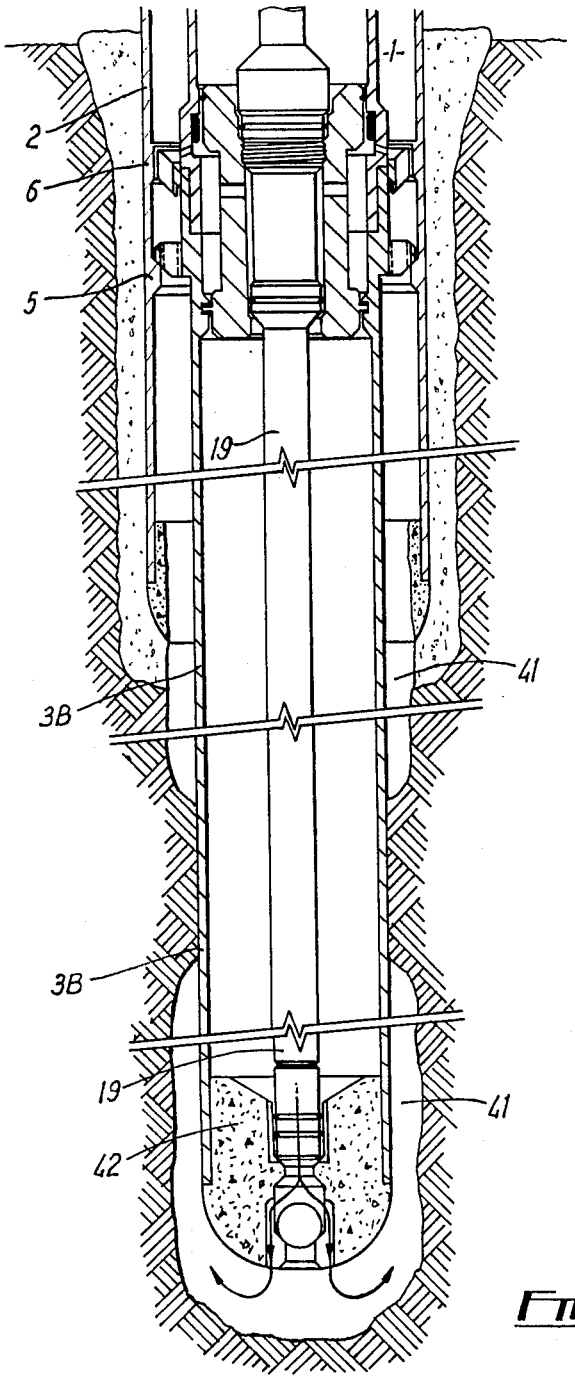
FIG. 3 schematically illustrates the equipment of FIGS. 1 and 2 being employed for stab-in annulus cementing.

FIG. 3 shows the system of FIGS. 1 and 2 being employed for conventional stab-in shoe cementing of the annulus around the 20 inch casing, following which the annulus 1 above the washports 7 is washed out as described below.

The middle sub 22 of the inner sleeve 13 provides means to connect the lower sub 20 and upper sub 21, and is perforated by a radial through port at 27. The drill string 14 is provided with means to redirect the flow; FIG. 1 depicts the flow passing directly to the end of the drill string 14, past a central sleeve 25 held in position by shear pins 25B, whereas FIG. 2 shows a ball 24 plugging the top of the sleeve 25 so that when fluid pressure is applied from above, the shear pins 25B are sheared and the sleeve 25 is displaced downwards to uncover the perforations 27 of the inner sleeve 13, permitting wash fluid to pass radially out through the wall of the inner sleeve 13 into the annulus 26 between the inner and outer sleeves 13, 12 of the assembly 11. From the annulus 26, wash fluid passes through radial perforations 28 in the extension 18 into the space 8. Hence, with the washports 7 in the 20 inch running tool 6 open, fluid pumped down the drill string 14 will pass into the annulus 1 between the conductor 2 and the running tool 6 and return to surface. The washports 7 are orientated to optimise washout and prevent channelling.

Once the annulus 1 is washed out the washports 7 must be closed. To achieve this, the seal sub 16 of the outer sleeve 12 is "unjayed", which involves a quarter-turn and slight withdrawal to disconnect, and the cementing string 19 is picked up. By virtue of this vertical movement, a split ring 29 of the torque tool 15 engages with a corresponding recess 30 in the inner face of the seal sleeve 10, preventing further upward movement. At the surface this is recognised by an increase in the lifted load. By then rotating the central assembly, spring loaded dogs 31 provided in the torque mechanism 15 engage in recesses 32 of the seal sleeve 10, and continued rotation of the drill string 14 then drives the seal sleeve 10 downwards, closing off the washports 7 (as shown in FIG. 2). At this point, pressure applied through the drill/cementing string 14 will test the integrity of the 20 inch casing hanger/running tool assembly 3. After testing the tool, the drill and cementing string 14, 19 are lifted with a force which deforms the split ring 29 thus releasing the central assembly 11 and allowing it to be retrieved to surface.

The annulus cementing and washout system of this first embodiment of the invention manipulates the seal sleeve 10 using a thread 33 between the running tool 6 and the seal sleeve 10 which is not subjected to side or bending loads imposed by the nature of jack-up drilling techniques which affect the hanger running tool 6 and mudline hanger 17 interface threads. Not only is the manipulation of the drill string 14 reduced, together with the problems associated therewith, but there is no longer the need for partial disconnection and then reconnection at the casing hanger 17 and running tool 6 interface.

Figure 4:
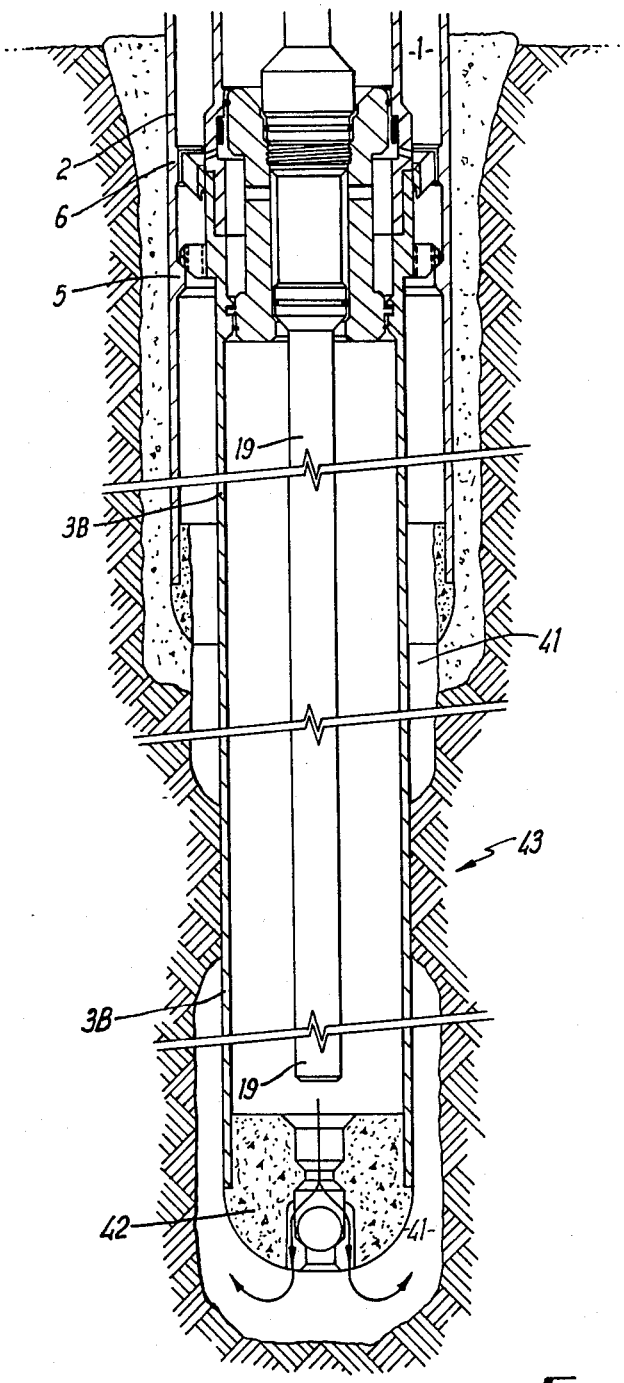
FIG. 4 schematically illustrates the equipment of FIGS. 1 and 2 being employed for pressure-balanced annulus cementing.

As the seals of the lower subs 16, 20 of the outer and inner sleeves 12, 13 of the assembly 11 isolate the 20 inch casing/drill string annulus 40 below the mudline, the system of this embodiment additionally enables the operator to pump cement into the annulus 41 (FIGS. 3 and 4) between the casing and drilled hole without engaging the cementing stinger in the 20 inch shoe 42, as shown in FIG. 4. Experience has shown that in the event of a blockage 43 in this annulus 41, pump pressure through an engaged stinger is limited by the inward collapse rating of the 20 inch casing (for example 770 psi). An open stinger method as shown in FIG. 4 allows pressure equalisation internally and the limiting factor becomes the outward burst rating of 20 inch casing (for example 2410 psi) above the blockage 43. Therefore this improved method allows the operator up to 200% extra pressure capacity to ensure a satisfactory cemented condition in the annulus 41 around the 20 inch casing. The facility to seal the 20 inch casing string and cement string at the mudline is not available in conventional systems, so the present system enables the operator to utilise an improved and safer cementing technique.

Figure 5:
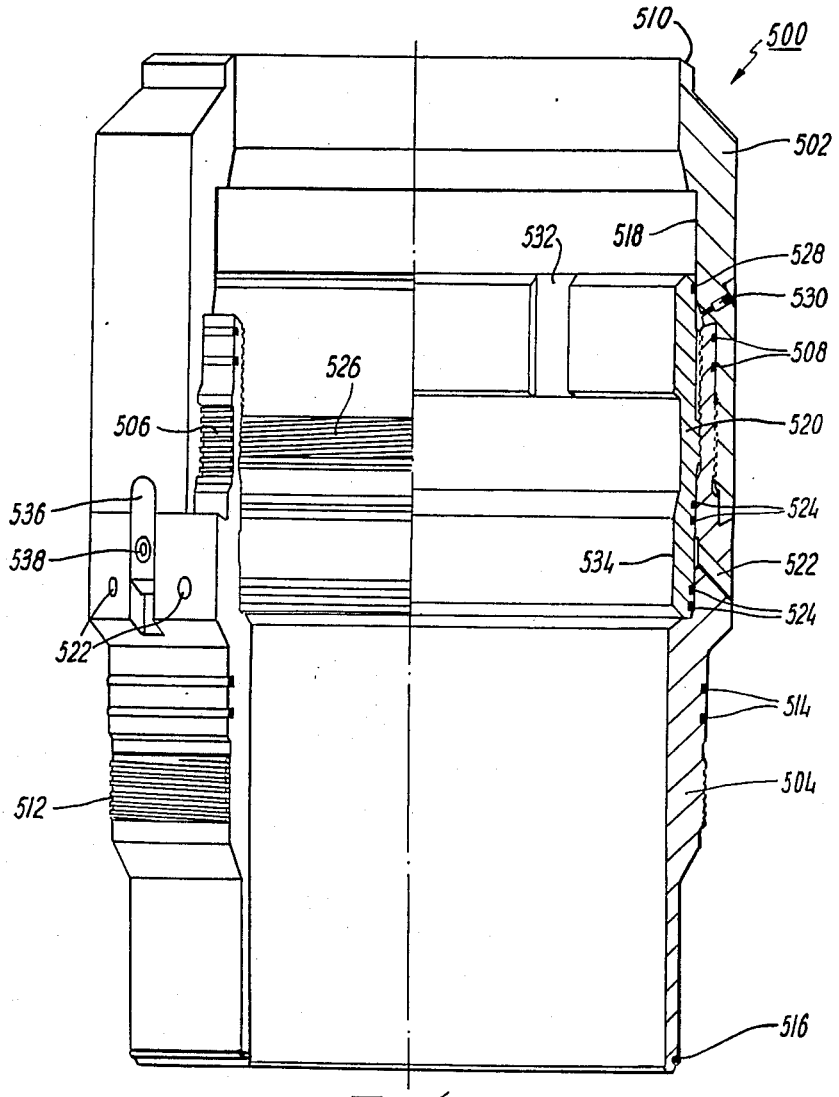
FIG. 5 shows a preferred form of washsleeve in part-sectional elevation.

Referring now to FIG. 5, this shows in part-sectional elevation and to an enlarged scale, a preferred form of washout casing section 500. The section 500 serves the same purpose as, but differs in detail from the combination of running tool 6 and seal sleeve 10 shown in FIGS. 1 and 2. The section 500 has a hollow cylindrical body formed by the combination of an upper sub body 502 joined to a lower sub body 504 by a screw-threaded connection 506. The upper and lower sub bodies 502 and 504 are mutually sealed by elastomeric O-rings 508. The section 500 is adapted to form part of a 20 inch casing string or hanger running tool by having its upper rim 501 bevelled for butt welding to a 20 inch casing (not shown in FIG. 5, but see FIGS. 8 and 9). The lower sub body 504 is formed with an external lefthanded running thread 512 by which the casing section 500 can be coupled to or uncoupled from a lower 20 inch casing section or string hanger, with sealing provided for by an upper pair of elastomeric O-rings 514 and a lower edge O-ring 516.

The interior of the hollow cylindrical body of the section 500 has an axially elongated annular recess 518 housing a hollow cylindrical seal sleeve 520. The axial length of the sleeve 520 is less than the axial length of the recess 518 such that the sleeve 520 has room to move from a first position (shown in FIGS. 5 and 8) at the bottom of the recess 518 to a second position (shown only in FIG. 9) at the top of the recess 518. In said first position, the sleeve 520 covers washports 522 passing radially through the lower sub body 504, in which position the flow of fluid through the ports 522 is blocked by the sleeve 520 in combination with two pairs of sleeve-mounted elastomeric O-rings 524. In said second position, the sleeve 520 is moved axially upwards within the recess 518 to uncover the washports 522 and so permit the passage (in use) of wash fluid therethrough.

Axial movement of the sleeve 520 within the recess 518 of the casing section 500 is controlled by a right-handed screw thread 526 linking the exterior surface of the sleeve 520 to the interior surface of the recess 518; specifically, to the upper end of the lower sub body 504. The screw thread 526 is protected from drilling fluids and debris by the combination of the O-rings 524 below the thread 526, and a further elastomeric O-ring 528 circumferentially fitted around the sleeve 520 above the thread 526. Prior to downhole use, the effectiveness of the seals 524 and 528 can be tested by pressurisation (e.g. with lubricating oil) through a sealable pressure port 530 sealed in use by a screw plug.

The sleeve 520 is rotated to move it between its first and second positions by means of a tool which will subsequently be detailed in FIG. 6. This tool is coupled to the sleeve 520 by means of radially protruding dogs (see FIG. 6) engaging axially extending slots 532 (FIG. 5) formed on the inner surface of the sleeve 520 for this purpose (and generally similar to the slots 32 shown in FIGS. 1 and 2).

The inner surface of the sleeve 520 is also formed with a circumferential recess 534 for coupling with the tool of FIG. 6 as detailed below (and generally similar to the recess 30 shown in FIGS. 1 and 2).

Figure 8:
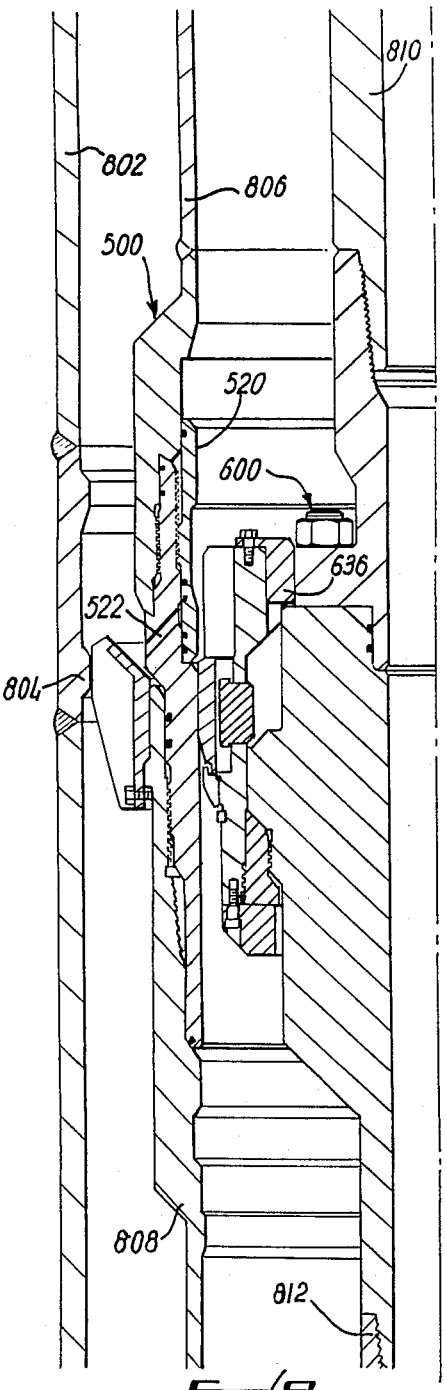
FIGS. 8 and 9 are views of the components of FIGS. 5, 6A and 6B together forming the second embodiment of an annulus cementing and washout system, in operational configuration corresponding respectively to FIGS. 1 and 2.
Figure 9:
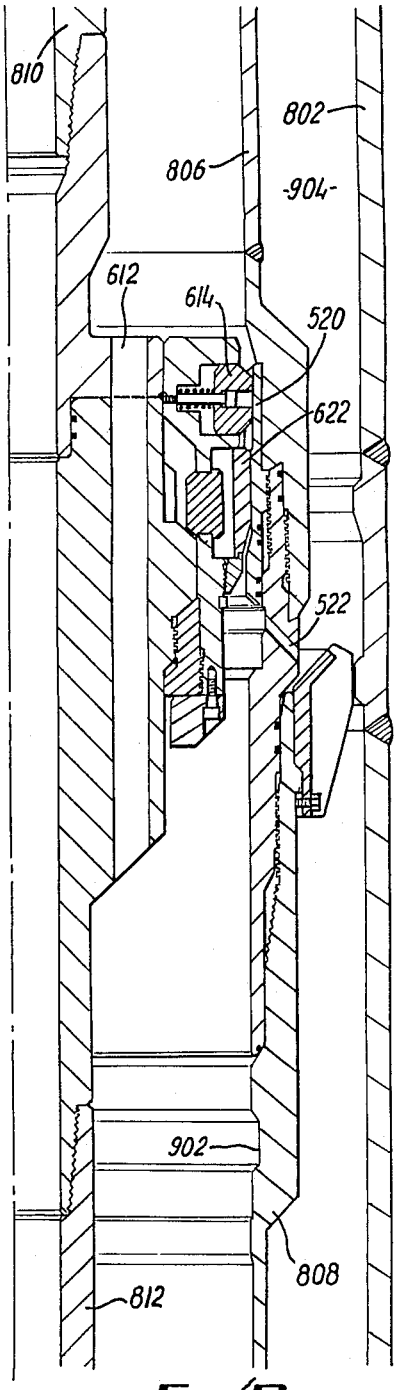

As will clearly be seen in FIG. 5, neither the sub bodies 502 and 504, nor the sleeve 520 (nor any other part of the section 500) has an internal diameter less than that of the 20 inch casing which will be welded to the rim 510 (see also FIGS. 8 and 9). Thus the casing section 500 will allow passage through it of any tool, bit, string, or instrument that would pass through a plain 20 inch casing.

In order to prevent undesirable relative rotation of the sub bodies 502 and 504 during downhole use, they are locked together by one or preferably several anti-rotation keys 536 each held in place by a retainer screw 538.

Turning now to FIGS. 6A and 6B, these show respectively in part-sectioned elevation and half of a circularly symmetrical plan view, a tool 600 for coupling with and operationally rotating the sleeve 520 (FIG. 5) to move the sleeve 520 axially between its first (washport closed) and second (washport open) positions.

Specifically referring to FIG. 6A, the tool 600 has a main body 602 with a tapered thread API drill pipe connector 604 at its lower end. The upper end of the tool 600 is formed as a tapered thread API drill pipe connector 606 secured to the main body 602 by a ring of stud and nut combinations 608. The main body 602 and the upper end connector 606 are each hollow throughout their length, and are mutually sealed by a pair of O-rings 610. Thus the tool 600 can be employed as a sub in an internally pressurised string, for example the cement stinger shown in FIGS. 3 and 4. A bypass throughflow passage 612 is formed between the axially opposite ends of the tool 600 separately from the central passage between the connectors 604 and 606 to permit the relatively free flow of fluid axially part the exterior of the tool 600.

The essential part of the tool 600 from the consideration of rotational coupling with the sleeve 520 consists of a circumferential row of angularly distributed dogs 614. Each dog 614 is retained within an individual recess in the upper end of a sleeve 616 carried on the outside of the main body 602 and into which it can be fully depressed against a respective compression spring 618 but is prevented from leaving by a retained screw 620. Each dog 614 has bevelled upper and lower edges which allows the tool 600 to be readily pulled or pushed through areas restricted to the outside diameter of the tool 600, while allowing the dogs 614 to extend radially out into slots for torque transmission.

Immediately below the circumferential row of dogs 614, the tool 600 carries a split ring 622. The ring 622 is formed with a single short gap in its circumference, and has a natural bias to expand beyond the diameter of the tool 600 while being capable of compression to within the diameter of the tool 600. An annular recess 624 in the sleeve 616 underlies the split ring 622 to allow the ring 622 to be radially depressed into the tool 600. The recess 624 restrains the ring 622 against axial movement relative to the sleeve 616. The split ring 622 is inhibited from indefinite expansion and radial separation from the tool 600 by a lipped retainer ring 626 screwed onto the sleeve 616 to overlie the edge of the annular recess 624. The retainer ring 626 is prevented from unscrewing by a circlip 628.

The sleeve 616 is axially retained on the body 602 by an internally and externally threaded ring 630 which is, in its turn, locked in place by a bevelled-edge ring 632 secured to the end of the sleeve 616 by screws 634. FIG. 6B shows how the sleeve 616 is angularly retained on the body 602, by means of a key 636 vertically inserted into aligned slots respectively on the external surface of the body 602 and the internal surface of the sleeve 616. The key 636 has an offset generally square head 638 of relatively large area, and is held in place by a screw 640 passing through the head 638 into the sleeve 616. The key head 638 is shown in dashed outline in FIG. 6B with the key 636 in its rotation inhibiting position in the slots between the body 602 and the sleeve 616; however, the key 636 can be lifted out of these slots and turned through 180 degrees about the axis of its retaining screw 640 to be clamped in a stowage slot in the outer surface of the sleeve 616 when the sleeve 616 is to be allowed to rotate on the body 602 (not in normal operation of the tool 600 as herein described with reference to FIGS. 8 and 9), in which configuration the key head 638 will occupy the position illustrated in full (undashed) lines.

Returning to FIG. 6A, the sleeve 616 has a number of apertures carrying radially slidable blocks 642 at the radially inner side of the annular recess 624. These blocks 642 do not take part in normal operation of the tool 600 as herein described with reference to FIGS. 8 and 9; however, when the ring 630 is unscrewed to uncouple the sleeve 616 from the body 602 for relative axial movement, dwnward movement of the sleeve 616 will bring the blocks 642 over the maximum diameter portion of the body 602 to lock the split ring 622 in its fully expanded configuration.

Figure 7:
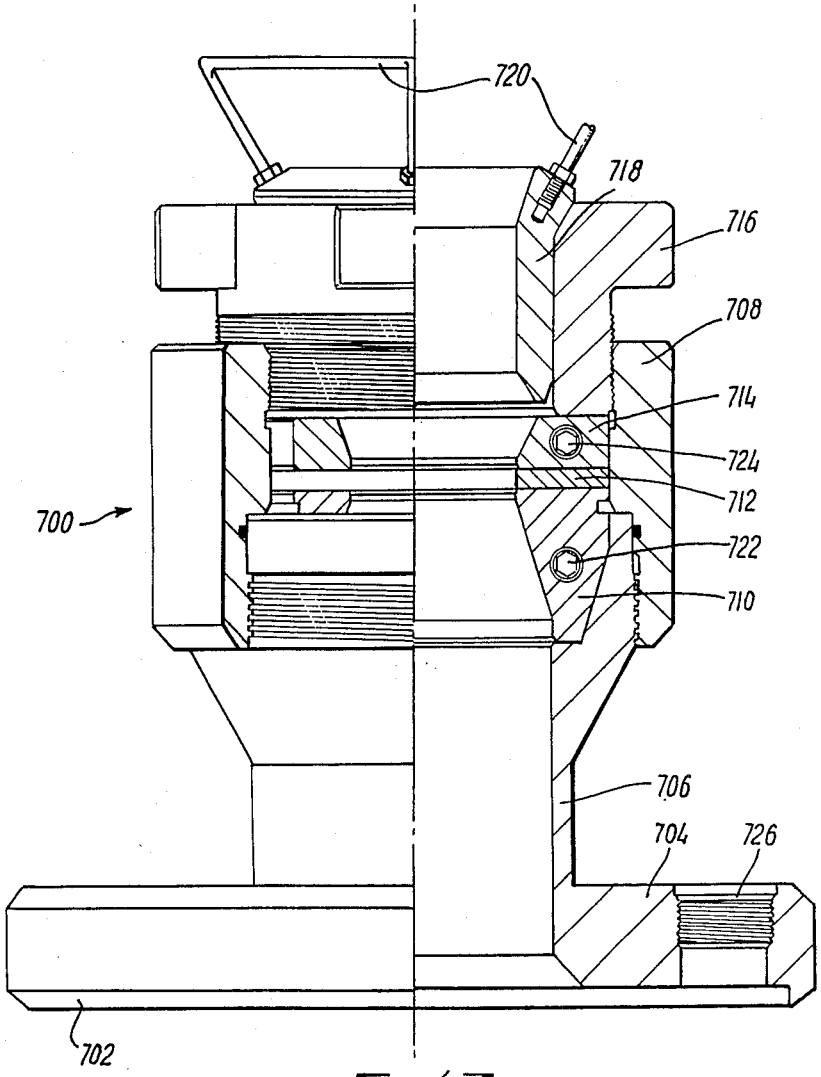
FIG. 7 shows a circulating head suitable for use with a second embodiment of the invention.

FIG. 7 shows a drill pipe seal system 700 for replacing the downhole sealing system of FIGS. 1 and 2. The seal system 700 (shown prior to installation) will, in use, be welded over the upper end of the topmost section of 20 inch casing prior to the annulus cementing and washout procedure by a butt weld applied to the bevelled edge 702 of the 20 inch diameter base flange 704. The flange 704 supports a central cylindrical body 706 onto which a seal housing 708 is screwed. The internally flared mouth of the body 706 carries an externally tapered split retainer bushing 710. A flat annular elastomeric seal 712 sits on top of the upper face of the bushing 710, and is sandwiched by a split compression ring 714. A peripherally castellated gland nut 716 can be screwed into the seal housing 708 to compress the ring 714 axially towards the bushing 710. This results in axial compression of the elastomeric seal 712 and hence causes the inside diameter of the seal 712 to grip and seal against a drill pipe (not shown) passing through the central bore of the seal system 700. (The dimensions of the seal system 700 will be selected to suit the external diameter of the drill pipe being used, and in particular to allow the drill pipe to pass freely through the central bore when the gland nut 7 is unscrewed, but to cause the drill pipe to be tightly sealed by the seal 712 when the gland nut 7 is screwed down).

The gland nut 716 optionally carries a pair of split landing bushes 718 each having one or more handles 720 for manipulation.

The halves of the split bushing 710 and of the split compression ring 714 are prevented from mutually separating (when detached from the seal system 700) by respective retainer screws 722 and 724. An elastomeric O-ring 726 seals the housing 708 to the body 706.

The flange 704 is formed with a two inch threaded port 726 to which a hose (not shown) may be coupled for pressurisation and washout of the casing to which the flange 704 is welded.

FIGS. 8 and 9 show the washout casing section of FIG. 5 and the seal sleeve operating tool of FIGS. 6A and 6B in their operating configurations. FIGS. 8 and 9 are respectively the left half of the cementing configuration and the right half of the washout configuration, joined together along their centre lines to give a ready lateral comparison of these two configurations.

Outermost in FIGS. 8 and 9 is a 30 inch casing 802 corresponding to the conductor 2 of FIGS. 1 and 2, including an upper landing sub 804 corresponding to centralising member 4. The washout casing section 500 (FIG. 5) has been butt welded to the bottom end of a 20 inch riser 806 to form a 20 inch hanger running tool which is screwed into a 20 inch mudline hanger sub 808. The tool 600 (FIG. 6) is coupled between the bottom end of a $6\frac{5}{8}$ inch drill string 810 and the top end of a $4\frac{1}{2}$ inch cement stinger string 812.

In FIG. 8 (left half of combined figures), the seal sleeve 520 has been fully screwed down to its first-/lowermost position in which the wash ports 522 are fully closed (as detailed with reference to FIG. 5). In FIG. 8, the string 810 and the cement stinger 812 are fully lowered for stab-in cementing generally as shown in FIG. 3, which also brings the tool 600 below the level at which it couples with the sleeve 520.

Alternatively (if as is preferable, the tool 600 is omitted from the cement stinger string during cementing), three or four stands of the drill pipe 810 are pulled and the tool 600 is installed in the string, with careful checking to ensure that the anti-rotation key 636 is in the inner position to lock the sleeve 616 to the body 602, following which two stands of the drill pipe 810 are reconnected. This ensures that when the central string is lowered, the bottom end of the cement stinger 812 is at least one stand above the float shoe and bottom end of the 20 inch casing during the washout procedures.

With the drill pipe 810 held in the drilldeck split plate by slips, the top connection is broken, the top stand of drill pipe 810 is lowered into the seal assembly 700 (minus the seal components 710–716), and the partial assembly 700 is fitted as close to the rotary table as possible. The seal components 710–716 are then fitted to the body 706, and the gland nut 716 is loosely screwed down. This assembly is then picked up, holding the assembly 700 high, and made up to the drill pipe connection. The seal assembly 700 is then lowered and coupled to the 20 inch casing.

The operator continues to run the stinger assembly into the hole until the tool 600 tags a $13\frac{3}{8}$ inch landing profile in the 20 inch hanger 808. The stinger assembly is then pulled up by about four feet until the split ring 622 expands into the annular recess 534 in the seal sleeve 520, as shown in FIG. 9 (right half of combined figures). The operator applies an overpull (excess of string lifting force over string weight) of 5000 pounds, and marks the top stinger pipe 810 with respect to the seal assembly 700.

Maintaining the overpull of 5000 pounds, the pipe 810 is rotated leftwards to turn the tool 600 anticlockwise as viewed from above. Within the first turn, the dogs 614 will be forced radially outwards by their respective springs 618 into the matching axial slots 532 inside the seal sleeve 520 to cause rotational coupling of the tool 600 to the sleeve 520. Thereafter, and maintaining an overpull of 5000 pounds, a further seven anticlockwise turns of the drill pipe 810 will screw the sleeve 520 axially upwards within the body of the washout casing section 500 to its second position in which the washports 522 are fully open. The string including the drill pipe 810 will rise by about two inches in this stage of the procedure. (The operator should take care not to apply an excessive torque that will break loose any of the numerous screwed connections).

When the sleeve 520 has been screwed upwards to open the washports 522, rotation of the string 810 is stopped and the gland nut 716 is tightened to squeeze the seal 712 onto the drill pipe 810 passing through it and so form a pressure-tight fluid seal.

Then sea water or drilling fluid (mud) is pumped down through the drill pipe 810 and the stinger 812 to wash out the annulus 904 between the casings 802 and 806 above the level of the washports 522. Annulus washout proceeds until the returns are clear of cement. Then the annulus washout is repeated twice to pump bottoms up. During the washout steps, it is preferable to maintain high pump flow rates and a pressure of 400–500 pounds per square inch. Alternatively, washout can be performed by pumping drilling mud through the port 726 in the flange 704 of the seal assembly 700, which will pass down through the tool 600 by way of the axial bypass passage 612.

When annulus washout is concluded, the gland nut 716 is unscrewed to loosen the grip of the seal 712 on the drill pipe 810. Maintaining an overpull of 5000 pounds on the drill pipe 810, the washports 522 are closed by turning the pipe 810 seven turns clockwise to screw the seal sleeve 520 from its upper/second position back to its lower/first position, at which point a torque build-up should be observed. The sleeve-closing torque is preferably limited to a maximum of 2000 foot pounds in excess of running torque.

A low-pressure test at 500 pounds per square inch can now be carried out by re-tightening the gland nut 716 and subsequent pressurisation through the drill pipe 810 and the stinger 812. If the float shoe at the bottom end of the 20 inch casing has been positively plugged, a complete casing test can be performed.

At the completion of the test procedures, the gland nut 716 is backed off and the seal components 710–716 are removed from the seal assembly 700. The tool 600 is disengaged from the washout casing section 500 by an overpull (possibly of about 10,000 pounds) to contract the split ring 622 sufficiently to allow it to leave the recess 534 and enter the casing riser 806. The remainder of the seal assembly 700 is removed. Then the entire central assembly of the drill pipes 810, the tool 600, and the stinger pipes 812 is pulled and dismantled to leave a cemented 20 inch casing with a washed-out annulus.

Modifications and variations of the above described equipment and procedures can be made within the scope of the appended claims.

We claim:

1. A casing string for use in a well, including an upper casing string and a lower casing string interconnected by a hanger running tool, the hanger running tool being detachably connected to the lower casing string for detachment when the lower casing string is fixed in position by cementation, the casing string including a washout casing section which comprises a hollow cylinder body adapted to form part of the length of said casing string and having at least one washport extending through said body between radially inner and outer surfaces thereof, said washout casing section further comprising a hollow cylindrical seal sleeve mounted within said body for axial movement relative thereto between a first position in which said at least one washport is closed to the passage of wash fluid therethrough, and a second position in which said at least one washport is open to the passage of wash fluid therethrough and said hollow cylindrical body being connected to a lower end of the upper casing string to form said hanger running tool.

2. A casing string as claimed in claim 1, wherein said hollow cylindrical seal sleeve is mounted on the interior of said hollow cylindrical body by a screw thread such that said relative axial movement of said sleeve and said body is achievable by rotating said sleeve within said body.

3. A casing string as claimed in claim 2, wherein said sleeve incorporates coupling means by which said sleeve is capable of being rotationally coupled to a remotely operated tool by which said sleeve is selectively rotated to cause axial movement from one to the other of said first and second positions.

4. A casing string as claimed in claim 1, wherein said hollow cylindrical seal sleeve is mounted within said hollow cylindrical body at a section of said body having an enlarged internal diameter, the body and the sleeve each having unimpeded passages axially therethrough of not less than a predetermined diameter.

5. A tool for remote operation of the washout casing section in the casing string according to claim 3, wherein said tool incorporates corresponding rotational coupling means engageable with the rotational coupling means incorporated in said sleeve such that the tool can apply torque to said sleeve to cause rotation of said sleeve within the body of the washout casing section.

6. An annulus cementing and washout procedure for cementing an annulus between an outer casing and a second-outer casing which is the casing radially next inwards from said outer casing, at the termination of said procedure said annulus being cement-filled substantially up to a predetermined level and washed substantially free of cement above said predetermined level, said procedure comprising the steps of providing said second-outer casing with a washout casing section substantially at said predetermined level, said washout casing section comprising a hollow cylindrical body adapted to form part of the length of said casing string and having at least one washport extending through said body between radially inner and outer surfaces thereof, said washout casing section further comprising a hollow cylindrical seal sleeve mounted within said body for axial movement relative thereto between a first position in which said at least one washport is closed to the passage of wash fluid therethrough, and a second position in which said at least one washport is open to the passage of wash fluid therethrough, moving said hollow cylindrical seal sleeve to said first position if not already in said first position, pumping liquid cement into said annulus until said annulus is filled with cement at least up to said predetermined level, moving said sleeve to said second position thereby to open said at least one washport, and pressurising at least the interior of said washout casing section with wash fluid to cause said wash fluid to pass through said at least one washport into said annulus to wash cement out of said annulus above said predetermined level.

7. A procedure as claimed in claim 6, wherein at the conclusion of annulus washout, said sleeve is returned from said second position to said first position to reclose said at least one washport.

8. A procedure as claimed in claim 6, wherein said second outer casing has its lower end terminated by a float shoe, and said cement is pumped into said annulus at the lower end thereof by a stinger casing coupled into said float shoe during cementing, said stinger casing incorporating a tool in accordance with claim 5 as a sub at a level which is below said washout casing section during cementing.

9. A procedure as claimed in claim 6, wherein said second-outer casing has its lower end terminated by a float shoe, and in the event of said annulus suffering a blockage or other impediment to being filled with liquid cement from the float shoe up to said predetermined level, the stinger is lifted free of the float shoe, the second-outer casing is sealed to the stinger casing at a level above the bottom end of the stinger, and liquid cement is supplied through the stinger to pressurise the interior of the second-outer casing up to its seal to the stinger casing at a pressure of up to the bursting point of the second-outer casing or a pressure which causes adequate amounts of cement to pass said annulus blockage or other impediment, whichever of said pressures is the lesser, and at the conclusion of annulus cementing, the washout procedure is commenced by opening the washport and washing out the interior of the second-outer casing by the application of wash fluid through the lower end of the stinger while holding said lower end of the stinger a relatively short distance above the float shoe, and continuing such application of wash fluid until the annulus is washed out.

* * * * *